US010066900B2

(12) United States Patent
Bowers

(10) Patent No.: US 10,066,900 B2
(45) Date of Patent: Sep. 4, 2018

(54) FIREARM STABILIZER

(71) Applicant: Barrett Bowers, Chantilly, VA (US)

(72) Inventor: Barrett Bowers, Chantilly, VA (US)

( * ) Notice: Subject to any disclaimer, the term of this patent is extended or adjusted under 35 U.S.C. 154(b) by 11 days.

(21) Appl. No.: 14/752,892

(22) Filed: Jun. 27, 2015

(65) Prior Publication Data

US 2016/0003577 A1 Jan. 7, 2016

Related U.S. Application Data

(60) Provisional application No. 62/021,080, filed on Jul. 4, 2014.

(51) Int. Cl.
*F41C 27/22* (2006.01)
*F41C 23/12* (2006.01)

(52) U.S. Cl.
CPC ..... *F41C 27/22* (2013.01); *F41C 23/12* (2013.01)

(58) Field of Classification Search
CPC F41C 23/10–23/12; F41C 27/22; F41G 11/00
USPC ..... 42/90, 97, 104
See application file for complete search history.

(56) References Cited

U.S. PATENT DOCUMENTS 1,372,763 A * 3/1921 Marcq ..... F41A 19/07 42/69.01
1,695,071 A * 12/1928 Villalpando ..... F41A 23/00 42/106
1,812,905 A * 7/1931 Stuyvesant ..... F41A 17/20 89/148
4,271,623 A * 6/1981 Beretta ..... F41C 23/12 42/71.02
4,555,973 A * 12/1985 Timari ..... F41A 11/04 89/1.4
4,660,311 A * 4/1987 Breitfeld ..... F41C 23/14 42/71.02
4,735,008 A * 4/1988 Williams ..... F41C 23/10 42/71.02
6,901,691 B1 * 6/2005 Little ..... F41A 23/02 42/118
7,111,424 B1 * 9/2006 Moody ..... F41A 23/08 248/171
7,140,138 B1 * 11/2006 Laney ..... F41A 19/14 42/69.03
7,367,152 B2 * 5/2008 Samson ..... F41C 27/00 42/128
7,591,098 B2 * 9/2009 Matthews ..... F41G 11/003 362/110
7,735,255 B1 * 6/2010 Kincaid ..... F41C 33/0254 362/110
7,823,316 B2 * 11/2010 Storch ..... F41C 27/00 42/127
8,393,104 B1 * 3/2013 Moody ..... F41C 23/14 42/71.01
9,021,734 B2 * 5/2015 Voigt ..... F41C 23/14 42/75.04
9,194,649 B2 * 11/2015 Nierenberg ..... F41A 3/66
(Continued)

*Primary Examiner* — Stephen Johnson
*Assistant Examiner* — Benjamin S Gomberg
(74) *Attorney, Agent, or Firm* — Chris Tanner, Esq.; TannerPatent.com FYPA, PLLC

(57) ABSTRACT

A system and apparatus for improving firearm accuracy, specifically as it relates to recoil management, is disclosed. The apparatus attaches to the rail system commonly found on many handguns.

14 Claims, 12 Drawing Sheets

(56) References Cited

U.S. PATENT DOCUMENTS

| | | | | |
|---|---|---|---|---|
| 2012/0167438 | A1* | 7/2012 | Daniel | F41G 11/004 42/90 |
| 2012/0317854 | A1* | 12/2012 | Nierenberg | F41C 23/06 42/1.06 |
| 2016/0146573 | A1* | 5/2016 | Kunkel | F41G 11/003 42/90 |

* cited by examiner

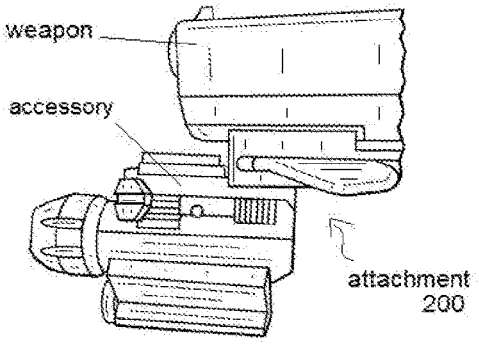
FIG. 2E (accessory rail 256 in use but obscured from view)
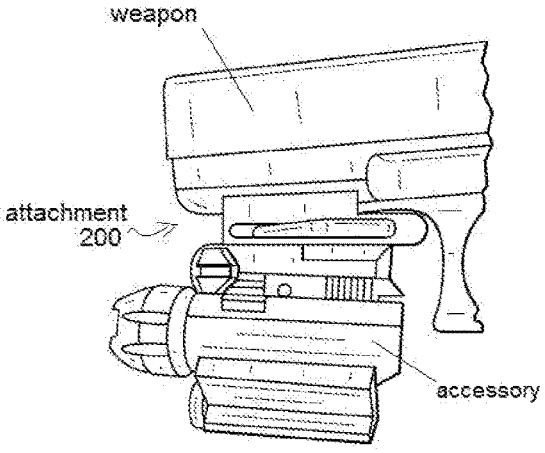
FIG. 2F (accessory rail 256 in use but obscured from view)
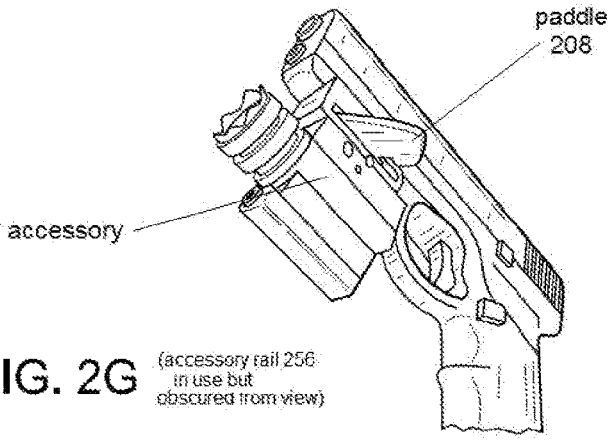
FIG. 2G (accessory rail 256 in use but obscured from view)

FIG. 3A ("in-use" position)
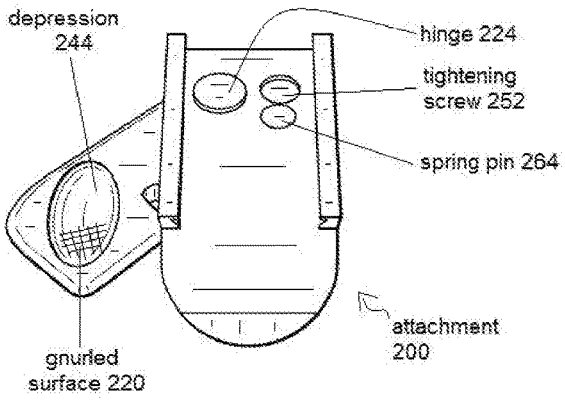
FIG. 3B ("non-use" position)
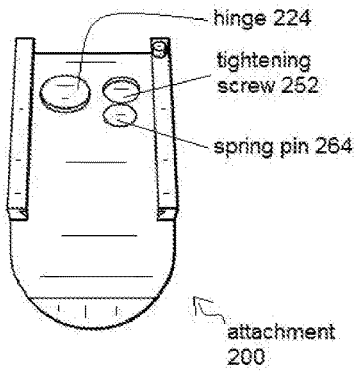
FIG. 3C
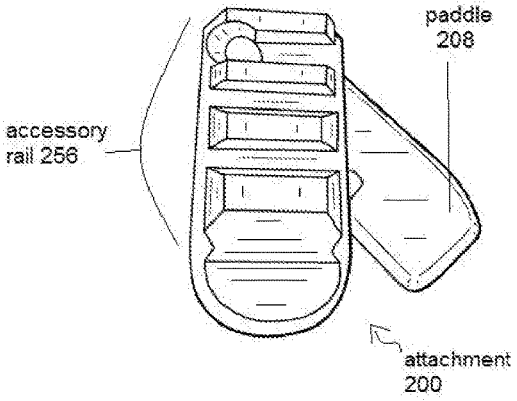
FIG. 3D
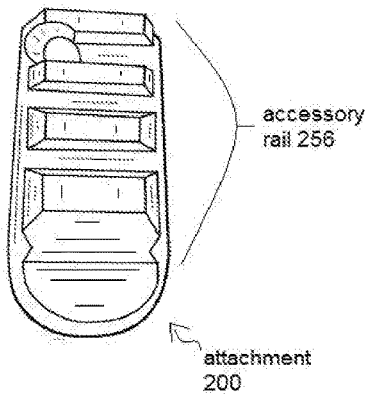

FIG. 4B (simplified)

FIG. 5A
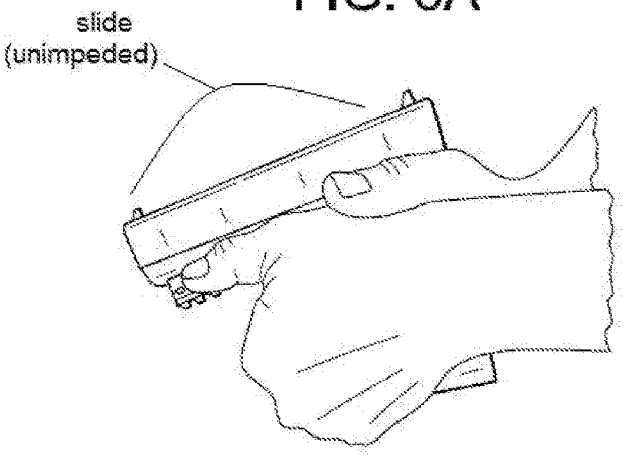
FIG. 5B
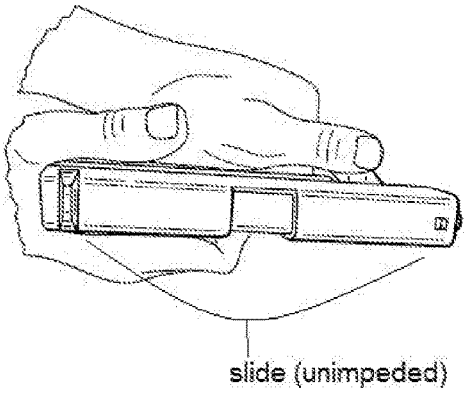
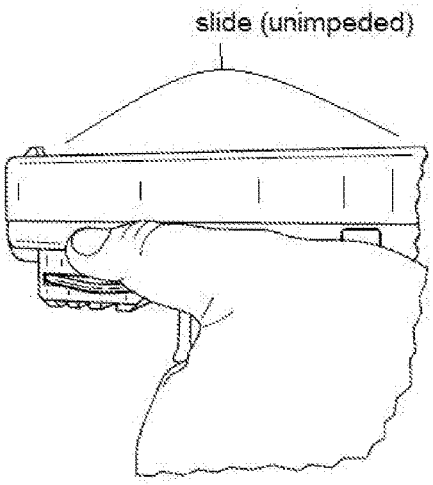
FIG. 5C

FIG. 7A ("in use" position)
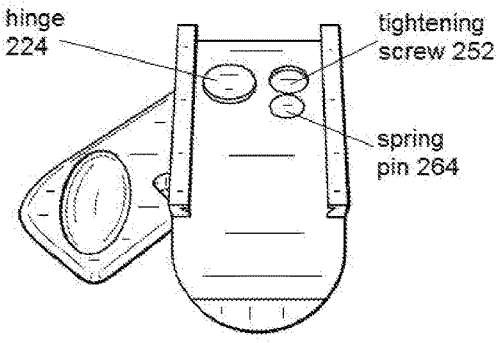
FIG. 7B (non-use position)
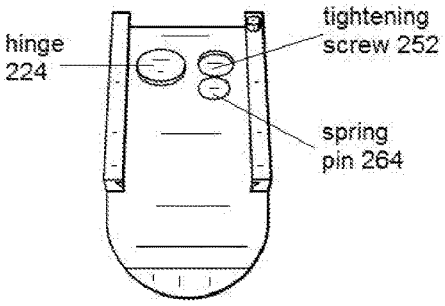
FIG. 7C (viewed from below)
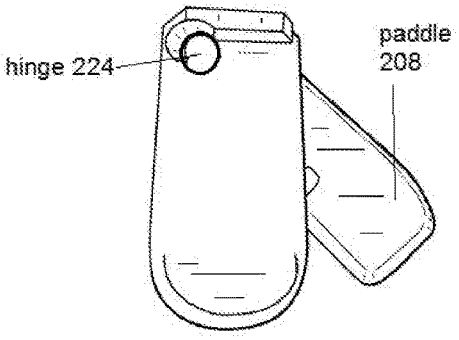
FIG. 7D
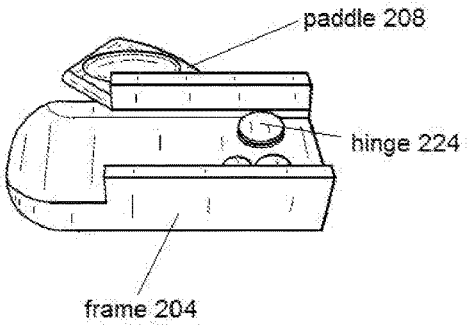

FIREARM STABILIZER

CROSS-REFERENCE TO RELATED APPLICATIONS

This application claims priority to Provisional Application No. 62/021,080, filed Jul. 4, 2014, the entire contents of which are hereby incorporated by reference.

FIELD OF THE INVENTION

The present invention relates to a system and apparatus for improving firearm accuracy, specifically as it relates to recoil management. The apparatus attaches to a rail system commonly found on many styles of handguns.

BACKGROUND OF THE INVENTION

When a handgun is fired, the muzzle tends to jump or raise as a consequence of the recoil caused by the firing of each bullet. This is sometimes known as muzzle flip, which causes the user to have to re-aim, re-adjust the handgun after each shot is fired. As a standard practice, shooters attempt to compensate for the recoil by applying vice-like pressure on the side of the firearm with their left thumb (assuming a right-handed shooter) positioned high and prominent on the side of the firearm. However, this process is known to not work real well, and can actually result in reducing accuracy and reducing speed of firing, given that lateral pressure does very little to reduce the vertical movement caused by recoil.

A traditional and popular handgun grip is shown in FIGS. 1A-C, sometimes referred to as "thumbs-forward". This position results in the shooter's support hand thumb resting on the frame of the gun. This often interferes with the slide (using the word "slide" in its noun form) of a typical gun as it moves backwards after each firing. This matters because the slide needs to move, uninhibited, to the rear of the gun after each shot in order to allow subsequent rounds/bullets to be in position for subsequent firing. This is such a problem that an entire line of products, sometimes called "thumb shields", have been developed. While thumb shields keep the shooter's support hand thumb off of the slide, they are not designed to mitigate recoil in any way.

It is sometimes attempted to reduce recoil and vertical muzzle flip by using devices that allow the shooter to apply downward pressure as the bullet leaves the gun. The mitigation of such muzzle flip can enable the shooter to quickly and accurately make follow-on shots. To address this, there exist various products on the market, sometimes termed 'thumb rests', that ostensibly mitigate muzzle flip by using a mechanism which allows exerting downward pressure with the support hand thumb during firing. However, these products are not known to be retractable. As such, a weapon with one of these thumb rest products can never be holstered. Additionally, such products often require the services of gunsmiths to attach the thumb rest, with the unwanted byproduct of permanently altering the handgun.

Consequently, a more effective mechanism for enabling a user to reduce or eliminate the "jump" or recoil effect is desired.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

BRIEF DESCRIPTION OF THE DRAWINGS

The present invention is illustrated by way of example, and not by way of limitation, in the figures of the accompanying drawings and in which like reference numerals refer to similar elements and in which:

FIGS. 2A-2G and 3A-3H show various views of an attachment, having an accessory rail manufactured therein;

FIGS. 4A-C shows more detail of an attachment;

FIGS. 5A-5C show how the embodiments disclosed herein do not impede movement of a slide;

FIGS. 7A-D show the embodiment of FIGS. 6A-C, without any weapon.

DETAILED DESCRIPTION OF THE PREFERRED EMBODIMENTS

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

Figure 1A:
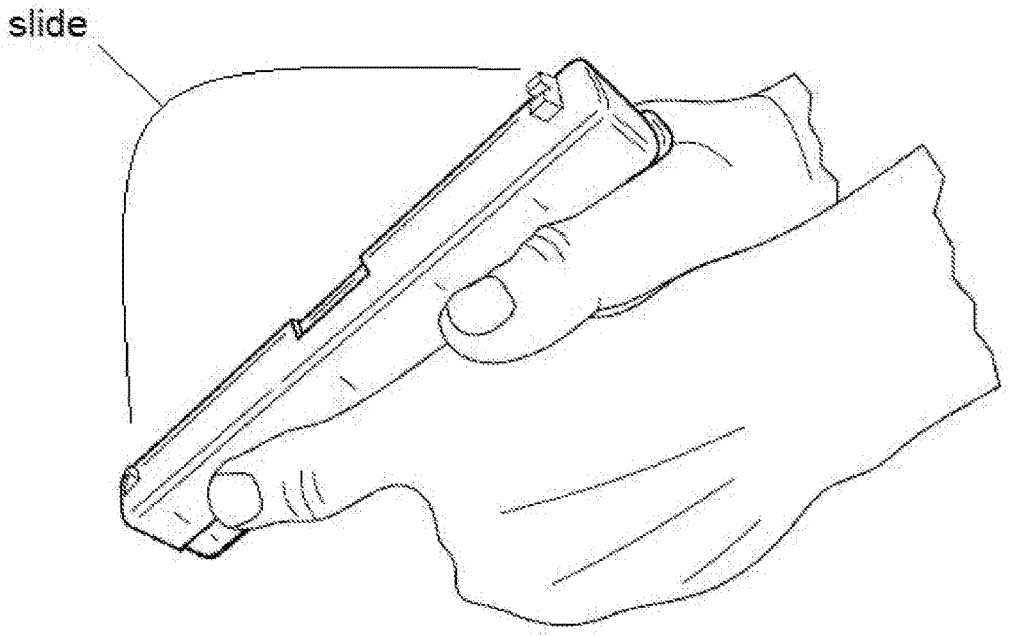
FIG. 1A PRIOR ART
FIGS. 1A-1C show a weapon being fired in a thumb-forward position.
Figure 1B:
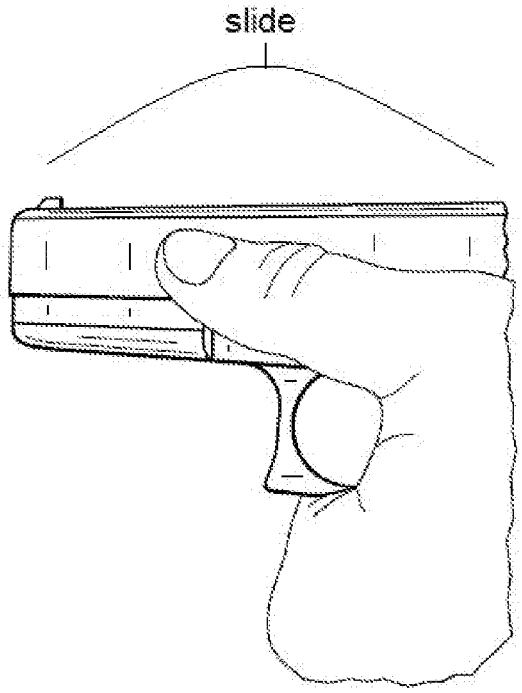
FIG. 1B PRIOR ART
Figure 1C:
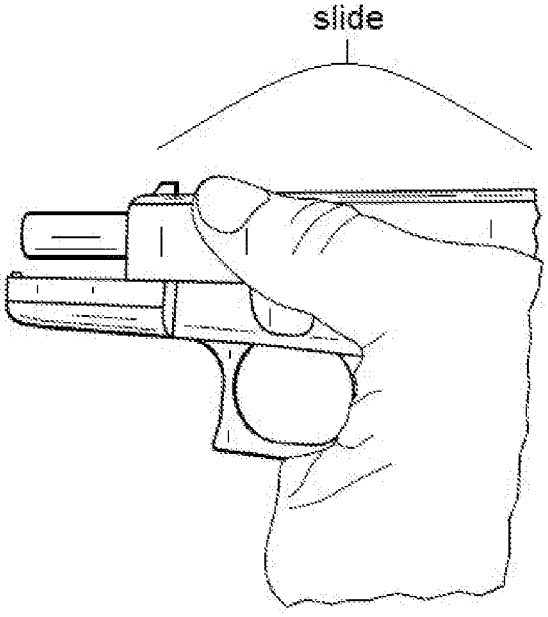
FIG. 1C PRIOR ART
Figure 1D:
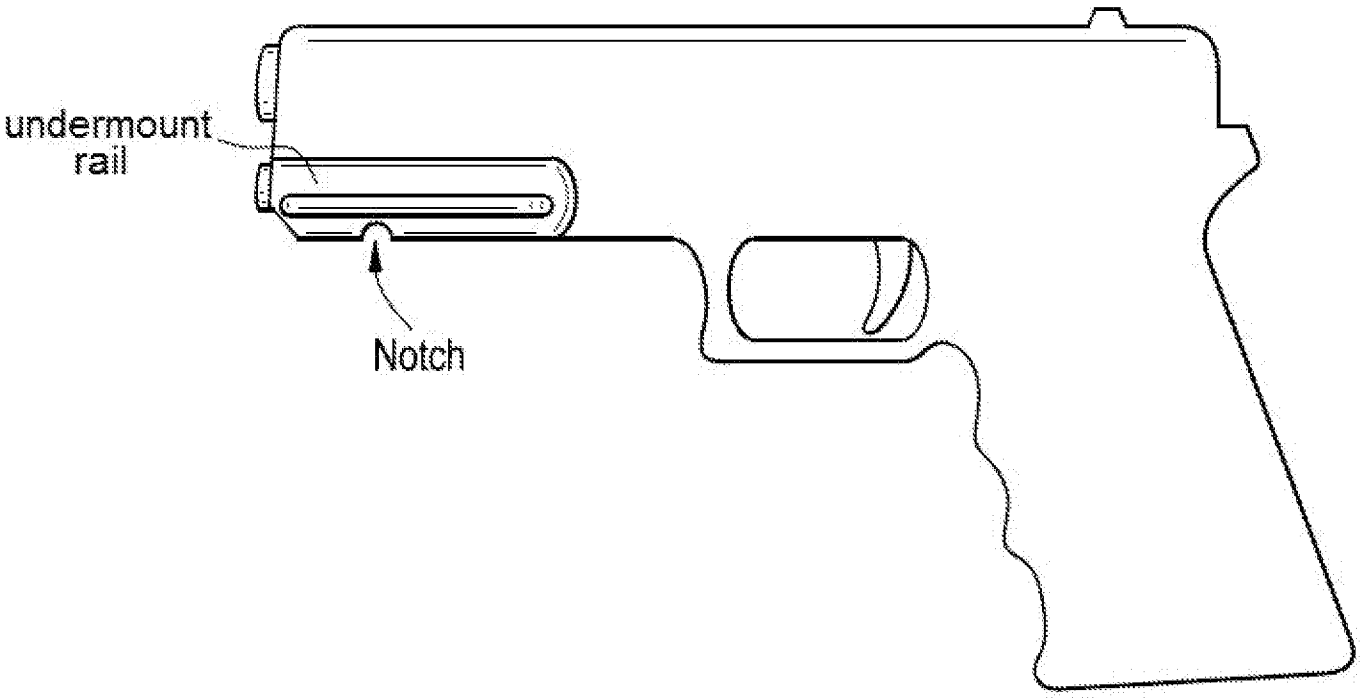
FIG. 1D (prior art)
FIG. 1D show a weapon with a conventional undermount rail.

FIG. 1D shows a prior art rail system 100 commonly found on many styles of handguns. This rail system is sometimes a Weaver Rail system, Weaver Rail, or a Universal Rail system or Universal rail. For simplicity and to avoid confusion, the rail system in FIG. 1D may also be referred as an undermount rail. FIG. 1D also depicts a locking notch commonly incorporated into the undermount rail. The notch assists in securing various devices that are attached to the rail system.

At least two alternative embodiments of the attachment 200 are disclosed herein. FIGS. 2A-G shows various views of an embodiment of the attachment 200 having an accessory rail 256 on its underside. A non-limiting example of such an accessory rail is a Picatinny rail. Meanwhile, the other embodiment of the attachment 200 will have a smooth underside. This would be suitable for user that do not want the option to include accessories. The embodiment with the accessory rail 256 is shown in FIGS. 2-3. The embodiment without such an accessory rail is shown in FIGS. 6-7. FIGS. 4 and 5 apply to both embodiments.

Within FIGS. 2A-G, a spring-loaded paddle 208 is shown in various views in both its in-use (outward) and non-use (retracted) positions. The circular receptacle shown in some of these views houses the single tightening screw 252.

Within FIGS. 3A-H, the paddle 208 is attached to a frame 204 at a pivot point or hinge 224. A tension spring 216 (shown in FIG. 4C but obscured from view in FIGS. 3A-H) continually urges the paddle 208 into an in-use/open position, working with a spring pin 264. The paddle 208 thus arrives into the in-use/open position as soon as the handgun is withdrawn from a holster. This adaptation is intended to accommodate a user that may want the paddle 208 in its in-use/open position instantly, without requiring any manual adjustment. For simplicity, within FIGS. 2A-G not all elements are always shown in every view.

An accessory rail 256 is also shown in various of FIGS. 2A-G. As stated, the accessory rail 256 can be in the form of a Picatinny rail.

Figure 2A:
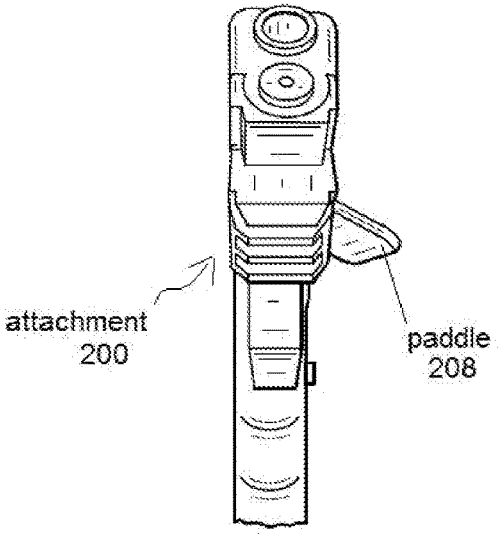
Figure 2B:
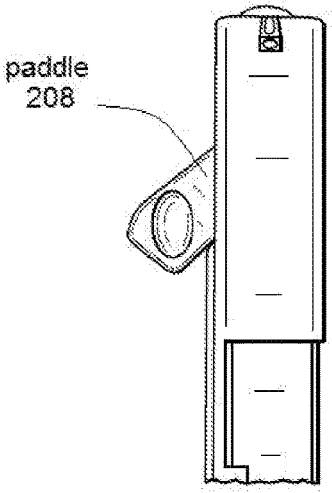
Figure 2C:
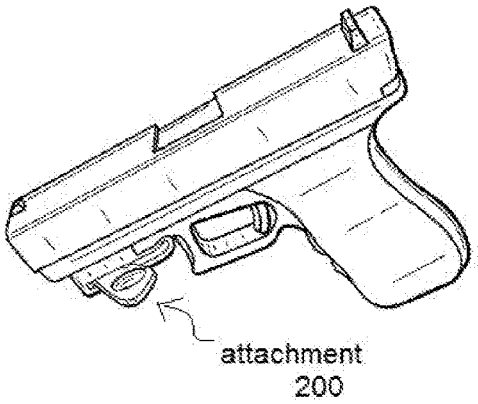
Figure 2D:
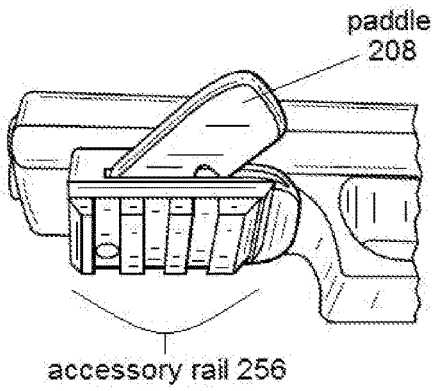
Figure 3E:
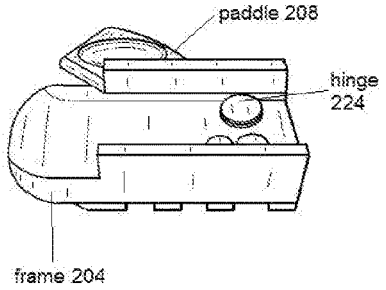
Figure 3F:
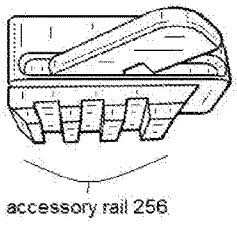
Figure 3G:
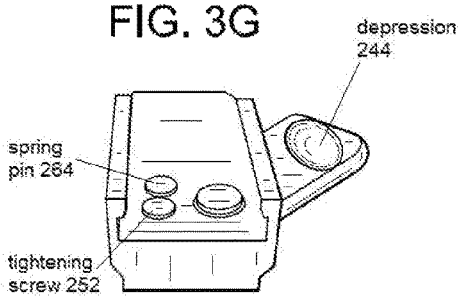
Figure 3H:
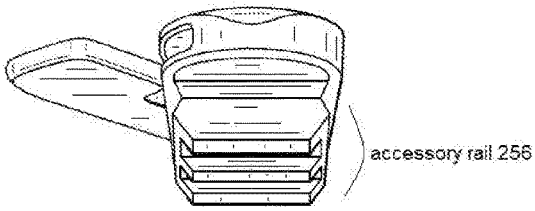

As shown at least within FIGS. 2B, 3A, and 3G, an indentation 244 on the top-side of the paddle thumb rest enables a no-slip surface for the thumb when applying downward pressure. However, either in addition to or in place of an indentation 244, a knurled or machined surface 220 can be located in a similar position, again for the purpose of provide a non-slip surface for a thumb of a user.

As stated, the FIGS. 2E-G show various views of the attachment 200 secured to a weapon. The tightening screw 252 assists in providing tight secure contact between the attachment 200 and the weapon. FIGS. 2E-G all show the embodiment with the accessory rail 256, in which a lighting device is attached to the accessory rail 256. It is to be noted that even with the addition of a laser or light accessory on the accessory rail 256, the attachment 200 can still be holstered in a variety of tactical holsters designed to accommodate such accessories.

Figure 4A:
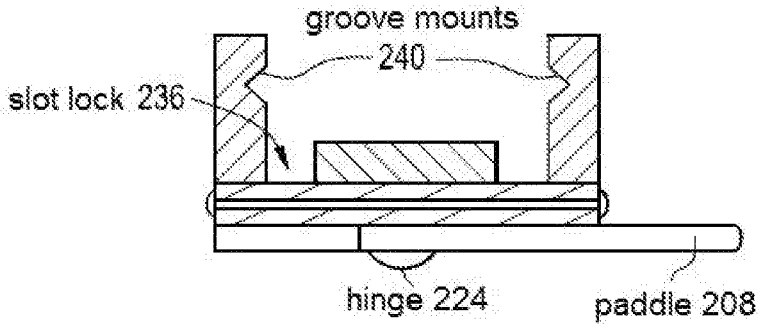
Figure 4A:
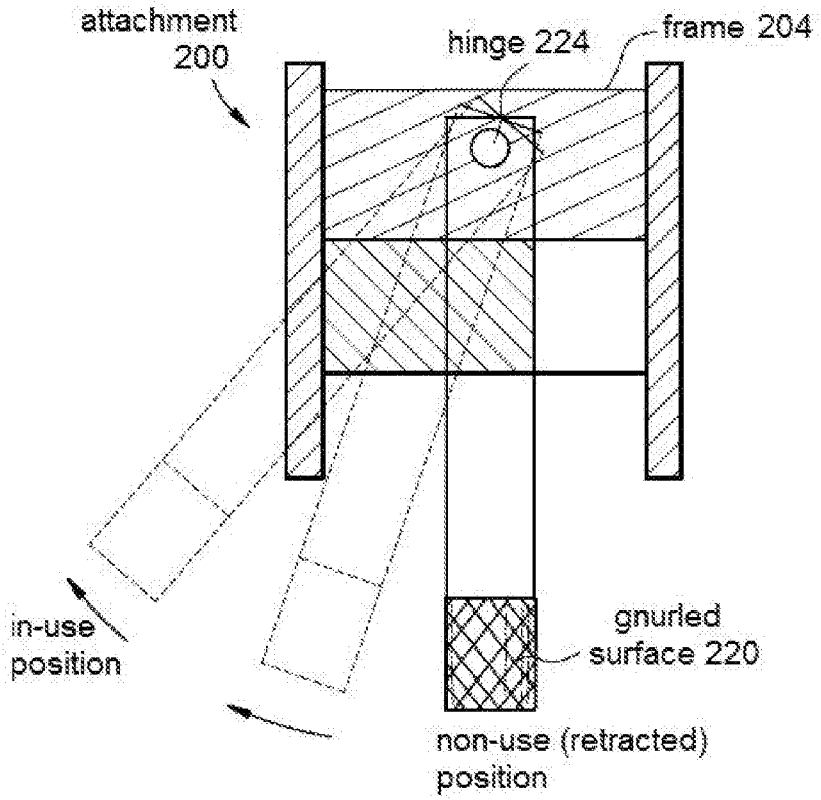
Figure 4C:
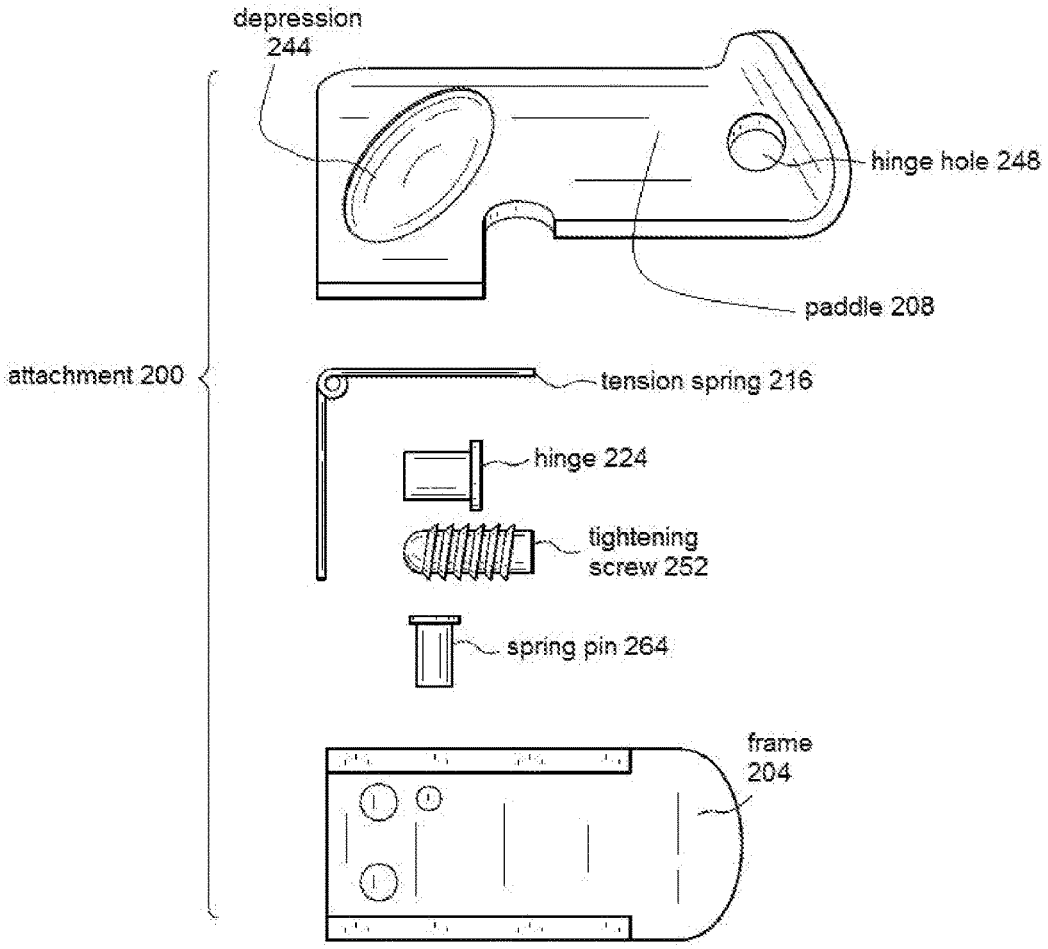

FIGS. 4A-B shows more detail of all embodiments. Specifically, FIG. 4A shows the attachment 200 from a front view. FIG. 4B shows the attachment 200 from underneath. FIG. 4C shows the attachment 200 in an exploded view. As stated, for simplicity and brevity, within FIGS. 4A-C not all parts are shown in every view.

Within the attachment 200, it is intended that re-holstering the firearm be facilitated and not impeded. Consequently, within the attachment 200, the pivot/hinge 224 and the hinge-hole 248 are positioned toward the front (discharge-end) of the firearm. This way, during a re-holstering process, the paddle 208 is naturally urged or impelled to return back to its storage non-use position as the muzzle enters the holster.

FIG. 4B shows a view of the knurled or other type of non-slip fingertip patterns 220 machined or manufactured or attached therein. In FIG. 4B, the paddle 208 is shown as a simple rectangle in order to convey principles of the embodiment related to movement. Further, while the paddle 208 is shown mostly in one specific shape, other shapes not shown in the Figures could also be utilized.

Additionally, the paddle can have a depression or indentation 244 machined therein, as shown in FIG. 4C. As stated, the depression 244 can be combined with the fingertip patterns 220, or either can be included separately, without the other.

The paddle 208 can be machined to have a predetermined contour/shape suitable for allowing the paddle 208 to be folded into to the attachment 200 as the gun is reholstered. Various sizes and shapes are contemplated, depending on manufacturing requirements. Further, the frame 204 can be machined to have a cavity suitable for accepting and housing the paddle 208. Again, this cavity can be in a variety of sizes.

FIG. 4A also shows a slot lock 236 and groove mounts 240. The slot lock 236 matches up with the locking notch shown in FIG. 1D, which is found on most handguns. Similarly, the groove mounts 240 match up with the undermount rail from FIG. 1D (found on most handguns). The groove mounts 240 are designed to slide on and off the undermount rail.

As stated, many firearms have a slide (again using the word 'slide' in its noun form) which moves in a direction parallel with the barrel. This slide must be able to move back and forth along the barrel in an uninhibited fashion after each shot, in order to allow subsequent rounds/bullets to be in position for subsequent firing. Accordingly, FIGS. 5A-5C show how the embodiments disclosed herein utilize a thumbs-forward grip, but do so in such a way as to take a user's support hand thumb completely off of the slide altogether. From FIGS. 5A-5C it is apparent that the user's thumb is not impeding movement of the slide.

Within the various Figures shown herein, the embodiments are shown for use by right-hand shooters. That is, all paddles 208 shown in the drawings herein are positioned for the left (non-shooting) thumb. However, although not explicitly shown in the drawings, the embodiments disclosed herein also can be adapted to be manufactured for left-handed users as well.

Figure 6A:
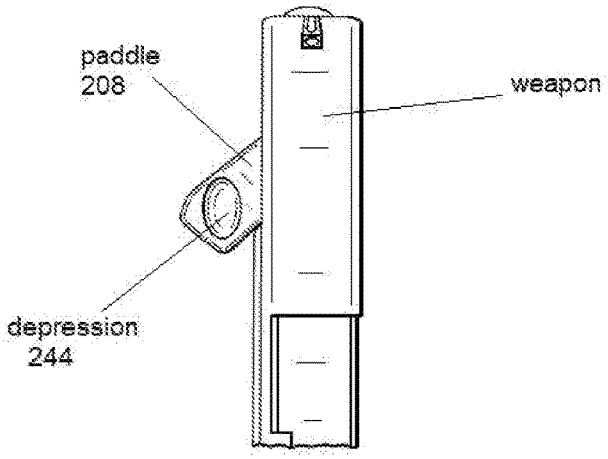
FIGS. 6A-C show an embodiment of the attachment that does not have an accessory rail, attached to a weapon.
Figure 6B:
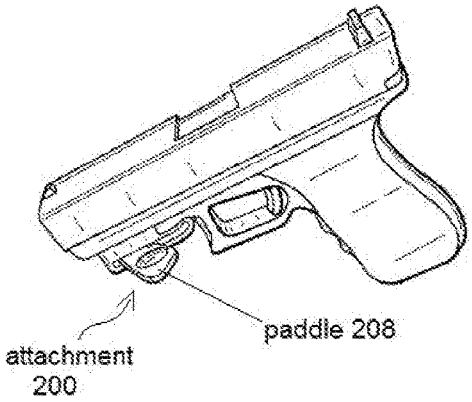
Figure 6C:
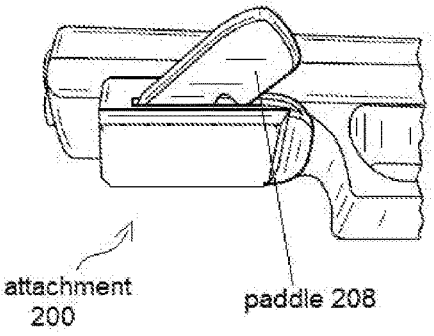

FIGS. 7A-D show an embodiment of the attachment 200 that does not have an accessory rail. FIGS. 6A-C show this embodiment attached to a weapon.

In an embodiment, the attachment 200 is made from aluminum, which is chosen for its durability, affordability, and malleability. However, a variety of other compositions could also be used, including but not limited to a composite plastic.

The embodiments of the attachment 200 are shown working with an undermount rail, such as but not limited to a Weaver Rail/Universal rail mount, for at least the following reasons. Accessories designed to fit the Weaver Rail/Universal rail will (in most cases) fit, albeit snugly, on a Picatinny Rail. This is because of larger recoil grooves/slot locks in the Picatinny system. Picatinny accessories, however, are too large to attach to the Weaver Rail/Universal rail, and would eventually (if not immediately) work themselves loose.

Meanwhile, the Picatinny system is used on the underside of the attachment 200 (FIGS. 2-3) because a military standard exists for the Picatinny system, and most tactical light/laser accessories are designed to fit this military standard.

The attachment 200 will fit the vast majority of handguns on the market with some type of Weaver/Universal Rail (as stated referred to herein as undermount rail). That said, the length of the accessory from front to back must be shorter than the distance from the end of the barrel/muzzle to the trigger guard. Additional embodiments, however, can be shortened and yet can still incorporate the full functionality of the attachment 200. As such, the attachment 200 will be manufactured in various lengths. The width of the attachment 200 should not change as most undermount rails are of a standardized size (as discussed earlier).

In an embodiment, it is possible to "blue" the attachment 200. That is, utilizing chemical/electric processes the attachment 200 can have a blacker appearance (despite the word "blue-ing"). Doing so is advantageous so that the attachment 200 will be an aesthetic match with the weapon. In another embodiment, the attachment 200 is equipped with a velcro tape material for securely fitting within a military-style back-pack. One purpose would be for safe keeping of the attachment 200 when not in use.

As stated, prior art and conventional products often require the services of gunsmiths to attach the accessory, with the unwanted byproduct of permanently altering the handgun. Meanwhile, the embodiments disclosed herein can be installed in seconds with just a few manual adjustments that can be made in seconds.

Step One: visually align the groove mounts 240 with grooves of the rail system on the underside of the weapon.

Step Two: slide the entire attachment 200 onto the existing rails of the weapon.

Step Three: continue sliding the attachment 200 until receiving a tactile sensation that a lock occurs between the slot lock 236 and the locking notch.

Step Four: insert a hex wrench into the single tightening screw 252 on the underside of the invention.

Step Five: turn the hex wrench a few rotations until receiving a tactile sensation of snugness.

In the foregoing specification, embodiments of the invention have been described with reference to numerous specific details that may vary from implementation to implementation. Thus, the sole and exclusive indicator of what is the invention, and is intended by the applicant to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. An apparatus for improving firearm accuracy, comprising:

a frame, configured to be attached to a firearm at an undermount rail contained within the firearm;

the firearm having a barrel with front and back ends;

the frame having a movable paddle attached thereto at a vertical hinge which is perpendicular to a longitudinal direction of the barrel, such that the paddle rotates about the vertical hinge in a horizontal plane which is parallel to the longitudinal direction of the barrel;

a spring attached to the paddle and continually urging the paddle into an in-use/open position, so that the movable paddle defaults to the in-use/open position;

the frame being positioned at the front end of the barrel; and the movable paddle being positioned at the front end of the barrel;

the paddle being subjected to downward pressure applied by a user during operation of the firearm;

the paddle having a top surface, a bottom surface, a front surface, a rear surface, and two lateral side surfaces;

the two lateral side surfaces being rectangular in outline such that the paddle has a predetermined uniform thickness;

the frame having a cavity located therein, the cavity having an upper wall, a lower wall, a front wall, and a back wall forming boundaries of the cavity;

the paddle having a predetermined contour/shape suitable for enabling the paddle to be folded into the cavity to a non-use/storage position; and the cavity having a predetermined height which is greater than the predetermined thickness of the paddle such that, when the paddle is in the non-use/storage position within the cavity, the top surface, the bottom surface, the front surface, the rear surface, and the two lateral side surfaces of the paddle are concealed entirely within the upper wall, the lower wall, the front wall, and the back wall of the cavity.

2. The apparatus of claim 1, wherein the frame and the paddle are located at a muzzle end of the firearm.

3. The apparatus of claim 2, further comprising:

a holster, located on a body or an article of clothing of the user; and while being inserted into the holster, the paddle is naturally urged or impelled to return back to the non-use/storage position as the muzzle end of the firearm enters the holster.

4. The apparatus of claim 1, wherein the paddle has knurled non-slip fingertip patterns embossed therein.

5. The apparatus of claim 1, further comprising: a tightening screw located within the frame.

6. The apparatus of claim 5, further comprising: one or more slot locks, cut or machined into the frame, which engage with the tightening screw to secure the frame to the firearm.

7. The apparatus of claim 1, further comprising: one or more groove mounts cut or machined into the frame, which act to slidably attach the frame to the undermount rail.

8. The apparatus of claim 1, wherein:

an underside of the frame has protrusions and grooves suitable for attaching accessories.

9. The apparatus of claim 8, wherein the protrusions and grooves on the underside of the frame facilitate attachment of a lighting mechanism.

10. The apparatus of claim 1, wherein:

an underside of the frame is substantially flat.

11. The apparatus of claim 1, further comprising: an indentation on the top surface of the paddle, thereby providing a no-slip surface for a thumb of the user when the downward pressure is applied by the user.

12. The apparatus of claim 1, further comprising: a knurled or carved or machined surface on the top surface of the paddle, thereby providing a no-slip surface for a thumb of the user when the downward pressure is applied by the user.

13. The apparatus of claim 1, the frame and the paddle adjoining a muzzle of the firearm.

14. The apparatus of claim 1, wherein the downward pressure applied to the paddle by the user is applied for counteracting recoil and muzzle jump of the firearm.

* * * * *